US010281148B2

(12) United States Patent
Taniguchi et al.

(10) Patent No.: US 10,281,148 B2
(45) Date of Patent: May 7, 2019

(54) BIOMASS-MIXED, PULVERIZED COAL-FIRED BURNER AND FUEL COMBUSTION METHOD

(71) Applicant: KAWASAKI JUKOGYO KABUSHIKI KAISHA, Kobe-shi, Hyogo-ken (JP)

(72) Inventors: Koji Taniguchi, Sakura (JP); Atsunori Kato, Kawasaki (JP); Suguru Yabara, Tokyo (JP); Yutaka Tanabe, Kasukabe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 494 days.

(21) Appl. No.: 14/386,951

(22) PCT Filed: Mar. 21, 2013

(86) PCT No.: PCT/JP2013/058116
§ 371 (c)(1),
(2) Date: Sep. 22, 2014

(87) PCT Pub. No.: WO2013/141311
PCT Pub. Date: Sep. 26, 2013

(65) Prior Publication Data

US 2015/0068438 A1 Mar. 12, 2015

(30) Foreign Application Priority Data

Mar. 21, 2012 (JP) ..... 2012-063030

(51) Int. Cl.
*F23C 6/04* (2006.01)
*F23C 7/00* (2006.01)
(Continued)

(52) U.S. Cl.
CPC ..... *F23G 7/10* (2013.01); *F23C 6/045* (2013.01); *F23C 7/004* (2013.01); *F23D 1/00* (2013.01);
(Continued)

(58) Field of Classification Search
CPC .... F23D 1/00; F23C 7/004; F23C 7/04; F23C 1/06
See application file for complete search history.

(56) References Cited

U.S. PATENT DOCUMENTS

2001/0022088 A1* 9/2001 Mandai ..... F23D 17/002 60/737
2003/0099913 A1* 5/2003 Kobayashi ..... F23C 5/32 431/10
(Continued)

FOREIGN PATENT DOCUMENTS

EP 2 249 081 A1 11/2010
JP A-56-119406 9/1981
(Continued)

OTHER PUBLICATIONS

International Search Report issued in International Application No. PCT/JP2013/058116 dated Jun. 25, 2013.
(Continued)

*Primary Examiner* — David J Laux
(74) *Attorney, Agent, or Firm* — Oliff PLC

(57) ABSTRACT

A biomass-mixed, pulverized coal-fired burner is provided. The biomass-mixed, pulverized coal-fired burner is capable of burning biomass fuel as auxiliary fuel in large quantities and burning only pulverized coal when the biomass fuel is not sufficiently available. The biomass-mixed, pulverized coal-fired burner includes: a biomass fuel jet nozzle that extends axially along the biomass-mixed, pulverized coal-fired burner; a pulverized coal fuel jet nozzle that surrounds
(Continued)

the biomass fuel jet nozzle; a secondary air nozzle that surrounds the pulverized coal fuel jet nozzle; and a tertiary air nozzle that surrounds the secondary air nozzle. A biomass fuel stream is jetted into an inside of a pulverized coal fuel flame formed in a furnace, the flame offering favorable ignition and flame holding performance.

12 Claims, 2 Drawing Sheets

(51) Int. Cl.
*F23D 1/00* (2006.01)
*F23G 7/10* (2006.01)

(52) U.S. Cl.
CPC ..... *F23C 2201/20* (2013.01); *F23C 2900/01001* (2013.01); *F23C 2900/06041* (2013.01); *F23D 2201/10* (2013.01); *F23D 2201/20* (2013.01); *F23D 2209/20* (2013.01)

(56) References Cited

U.S. PATENT DOCUMENTS

| | | | | |
|---|---|---|---|---|
| 2004/0211345 | A1* | 10/2004 | Okazaki | F23C 6/045 110/261 |
| 2005/0120927 | A1 | 6/2005 | Okazaki et al. | |
| 2005/0211142 | A1* | 9/2005 | Yamamoto | F23C 7/008 110/265 |
| 2010/0275824 | A1* | 11/2010 | LaRue | F23C 7/004 110/346 |
| 2012/0272875 | A1* | 11/2012 | Hamel | F23C 7/008 110/264 |
| 2014/0202365 | A1* | 7/2014 | Sturgeon | F23K 3/02 110/347 |
| 2014/0373763 | A1* | 12/2014 | LaRue | F23C 9/003 110/264 |

FOREIGN PATENT DOCUMENTS

| | | |
|---|---|---|
| JP | A-4-20702 | 1/1992 |
| JP | A-9-26112 | 1/1997 |
| JP | A-2003-222310 | 8/2003 |
| JP | A-2005-140480 | 6/2005 |
| JP | A-2005-291524 | 10/2005 |
| JP | A-2005-291534 | 10/2005 |
| JP | A-2007-101083 | 4/2007 |
| JP | A-2007-333232 | 12/2007 |
| JP | A-2010-261707 | 11/2010 |
| WO | 97/47923 A1 | 12/1997 |

OTHER PUBLICATIONS

International Preliminary Report on Patentability issued in International Application No. PCT/JP2013/058116 dated Sep. 23, 2014.
Oct. 2, 2015 Extended Search Report issued in European Patent Application No. 13764750.9.

* cited by examiner

BIOMASS-MIXED, PULVERIZED COAL-FIRED BURNER AND FUEL COMBUSTION METHOD

TECHNICAL FIELD

The present invention relates to a biomass-mixed, pulverized coal-fired burner that burns biomass fuel together with pulverized coal in a mixed state and to a fuel combustion method.

BACKGROUND ART

Recently, a need exists to promote planned performance of steps against global warming. Of the total greenhouse effect gases discharged in Japan, energy-derived CO2 emissions account for about 90% in recent years. Moreover, of the total power generated, coal-fired power plant discharges 50% CO2. Thus, coal-fired power plants are required to promote the use of new types of energy having low environmental impact.

Organic substances repeat a cycle of decomposition, absorption, and release. Equilibrium can thus be achieved for the amount of CO2 discharged by biomass energy by having a source of absorbing the equal amount of CO2. In this way, biomass is a carbon neutral fuel and thus biomass power generation carries the weight of expectations as new energy, which can reduce the amount of used fossil fuels and the amount of CO2 emissions. Easily collectable woody biomass includes wood pellets and wood chips.

Additionally, use of the biomass fuel as auxiliary fuel in the coal-fired boiler reduces the amount of NOx contained in combustion exhaust gases because the biomass fuel contains a low nitrogen content.

Against this background, coal-fired boilers are required to introduce the biomass-mixed combustion system so as to promote the use of new energy.

Among boilers using biomass, there is a biomass-mixed fired boiler that burns pulverized fuel which is a mixture of pulverized coal and biomass fuel. A typical system uses a conventional pulverized coal-fired boiler and manufactures a mixed fuel of pulverized coal and biomass by, for example, adding a woody biomass material to a roller or other type of mill that crushes coal into fine powder. The system then conveys the mixed fuel on conveyance air and burns the mixed fuel using the pulverized coal burner.

The roller mill pulverizes coal into fine particles of commonly 200 μm or less, preferably about 70 μm, in order to improve combustion efficiency of the burner. At this time the coal and the biomass fuel are treated together, thus the biomass fuel is also pulverized into fine particles. The produced mixed fuel has an aggravated product grain size results with a resultant increase in the amount of coarse components of 100 μm or more. The product fuel has a grain size distribution expanded both in coarse and fine directions. Further, fine pulverization of the biomass fuel requires a great power, which increases the unit requirement.

In addition, the woody biomass fuel and the pulverized coal have combustion characteristics different from each other. For example, the woody biomass has a volatile content twice as high as that of coal. The wood pellet has a calorific value of ⅔ of that of coal and the wood chip has a calorific value of ½ of that of coal. The wood pellet and the wood chip have an ash content of 1/10 or less of that of coal. Meanwhile, the woody biomass fuel and the pulverized coal require different amount of air for combustion. Thus, when the woody biomass and the pulverized coal are co-fired with certain amount of air, depending on the mixing ratio of the woody biomass and the pulverized coal, the combustion condition will not always be preferable. The biomass fuel mixing ratio (calorific value ratio) in the pulverized coal boiler is 3% in terms of actual industrial applications and the limit is estimated to be about 5%.

To burn the woody biomass fuel efficiently, a biomass fired burner can be employed so that the pulverized coal and the woody biomass fuel will be burned separately.

The finer the woody biomass is pulverized, the more the power is required in pulverization, which increases the unit requirement. On the other hand, the woody biomass fuel is easier to burn than coal if particle diameters are the same, which eliminates the need for making small the pulverized grain size.

When a biomass fired burner is used together with a pulverized coal-fired burner, a pulverizing mill can be operated under conditions suitable for the woody biomass fuel independently of the pulverized coal. A boiler can be operated with a suitable mixed fuel burning ratio selected as against the pulverized coal fuel.

Patent Document 1 discloses a biomass fired burner that is applied to a biomass-mixed fired boiler that loads pulverized coal and woody biomass fuel through respective lines into a furnace for combustion. The disclosed biomass fired burner includes a biomass fuel jet nozzle. The biomass fuel jet nozzle includes: a disperser disposed at a center of the biomass fuel jet nozzle, the disperser preventing uneven flow of the biomass fuel; a venturi disposed upstream inside the nozzle, the venturi increasing flow velocity of the fuel to thereby cause biomass fuel particles to collide with the disperser; a flame stabilizer disposed at a leading end of the biomass fuel jet nozzle, the flame stabilizer having a stepped enlarging structure for sharply expanding the biomass fuel stream; and a combustion air nozzle disposed on the outside of the biomass fuel jet nozzle, the combustion air nozzle supplying a secondary air swirl flow.

The biomass fired burner is optimized for burning a predetermined amount of biomass fuel. The number of biomass fired burners to be installed may be determined according to the amount of biomass fuel to be processed required in the furnace to which the burners are applied. The arrangement disclosed in Patent Document 1 has a mixed fuel burning ratio of 15%.

Patent Document 2 discloses a boiler that includes a biomass-mixed fired burner burning pulverized coal and biomass fuel and a boiler that includes a starting or auxiliary burner that functions also as a biomass fuel burning burner that burns biomass fuel supplied intermittently thereto. Patent Document 2 does not, however, describe any specific configuration of the biomass fired burner, problems encountered during its use, solving means, and the like.

Patent Document 3 discloses a pulverized coal fired burner. The disclosed burner is adapted to pulverized coal that has a greater calorific value, a greater amount of air required for combustion, and greater specific gravity than those of the biomass fuel and thus has a small optimum grain size. Accordingly, the burner in Patent Document 3 cannot be directly used for burning the woody biomass fuel.

PRIOR ART DOCUMENTS

Patent Documents

Patent Document 1: JP-A-2005-291534
Patent Document 2: JP-A-2005-291524
Patent Document 3: JP-A-H09-26112

DISCLOSURE OF THE INVENTION

The greater the amount of biomass is burned, the more ideal the biomass used as the auxiliary fuel in, for example, a biomass-mixed, pulverized coal-fired burner is. Unfortunately, however, a supply of the biomass material is not necessarily steady currently.

It is an object of the present invention to provide a biomass-mixed, pulverized coal-fired burner capable of burning biomass fuel as auxiliary fuel in large quantities and burning only pulverized coal when the biomass fuel is not sufficiently available, and to provide a fuel combustion method.

To achieve the foregoing object, an aspect of the present invention provides a biomass-mixed, pulverized coal-fired burner, comprising: a biomass fuel jet nozzle having a biomass fuel jet port that jets biomass fuel conveyed by biomass fuel primary air as a biomass fuel stream; a pulverized coal fuel jet nozzle having a pulverized coal fuel jet port that surrounds an opening in the biomass fuel jet port, the pulverized coal fuel jet port jetting pulverized coal fuel conveyed by pulverized coal fuel primary air as a pulverized coal fuel stream; a secondary air nozzle having a secondary air jet port that surrounds an opening in the pulverized coal fuel jet port, the secondary air jet port jetting secondary air; and a tertiary air nozzle having a tertiary air jet port that surrounds the secondary air jet port, the tertiary air jet port jetting a tertiary air swirl flow.

In addition, another aspect of the present invention provides a fuel combustion method comprising: burning biomass fuel and pulverized coal fuel using the biomass-mixed, pulverized coal-fired burner according to the aspect of the present invention.

The biomass fuel jet nozzle includes a biomass fuel conveying pipe that forms a flow path for the biomass fuel stream, and includes a biomass fuel swirl vane that converts the biomass fuel stream to a swirl flow whirling around an axis of the biomass fuel conveying pipe to thereby make a fuel concentration lower on an axis side of the biomass fuel conveying pipe and higher on an outer circumferential wall side of the biomass fuel conveying pipe. The biomass fuel jet port has a pipe end extending in parallel with a pipe axis. The biomass fuel jet nozzle further includes a biomass fuel baffle plate disposed on a pipe inner wall upstream of the pipe end, the biomass fuel baffle plate reducing a swirl of the biomass fuel stream jetted from the biomass fuel jet port.

The pulverized coal fuel jet nozzle includes a pulverized coal fuel conveying pipe that forms a flow path for the pulverized coal fuel stream, a pulverized coal fuel swirl vane that converts the pulverized coal fuel stream to a swirl flow whirling around an outer circumference of the biomass fuel jet nozzle to thereby make a fuel concentration lower on an axis side of the pulverized coal fuel conveying pipe and higher on an outer circumferential wall side of the pulverized coal fuel conveying pipe, a flame stabilizer having a funnel-shaped opening at a pipe end of the pulverized coal fuel jet port, and a pulverized coal fuel baffle plate disposed on a pipe inner wall upstream of the flame stabilizer, the pulverized coal fuel baffle plate reducing a swirl of the pulverized coal fuel stream jetted from the pulverized coal fuel jet port.

The secondary air jetted from the secondary air jet port forms a buffer stream between the pulverized coal fuel stream and the tertiary air swirl flow. The pulverized coal fuel stream is formed such that the biomass fuel stream jetted from the biomass fuel jet port is enveloped by the pulverized coal fuel stream jetted from the pulverized coal fuel jet port.

In the biomass-mixed, pulverized coal-fired burner according to the aspect of the present invention, the biomass fuel stream conveyed by air is turned into a swirl inside the biomass fuel jet nozzle, so that the resultant fuel stream having a higher concentration of fuel component on the pipe wall side of the nozzle. A degree of swirl of the biomass fuel stream is thereafter reduced and a resultant fuel stream having a relatively reduced diameter is jetted into the furnace from a straight pipe-shaped opening at the biomass fuel jet port disposed on the side of a burner axis.

In addition, the pulverized coal fuel stream conveyed by air is turned into a swirl inside the pulverized coal fuel jet nozzle, so that the resultant fuel stream having a higher concentration of fuel component on the pipe wall side of the nozzle. The degree of swirl of the pulverized coal fuel stream is thereafter reduced and a resultant fuel stream is jetted into the furnace from an outer circumferential portion of the biomass fuel stream so as to envelope a jet stream of the biomass fuel.

The secondary air is supplied to an outer circumference of the pulverized coal fuel stream and the tertiary air is supplied to an outer circumference of the secondary air.

The flame stabilizer disposed at a pipe end of the pulverized coal fuel jet port allows the pulverized coal to be dispersed in the furnace and generates a relatively large reverse flow range. This facilitates ignition of the burner and holding of the flame.

In addition, the pulverized coal fuel stream is guided into the flame stabilizer having the funnel-shaped opening and jetted to spread in the furnace. In this case, the secondary and tertiary air for combustion jetted from the jet ports for the combustion air is diverted outwardly to thereby retard mixing of the pulverized coal fuel and the air and burn the mixture in a reducing atmosphere, so that NOx can be reduced.

The biomass fuel is jetted into a flame of the pulverized coal having favorable flame holding performance to thereby be ignited and hold its flame. Thus, the biomass fuel can burn steadily over a wide mixing ratio relative to the pulverized coal fuel from low to high. The biomass-mixed, pulverized coal-fired burner according to the aspect of the present invention is capable of burning favorably even at a mixed fuel burning ratio of 60% by weight of the biomass fuel and of burning only the pulverized coal.

The biomass-mixed, pulverized coal-fired burner according to the aspect of the present invention includes a supply path for the pulverized coal fuel and a supply path for the biomass fuel independent of each other. This allows the use of a pulverizing mill dedicated to the biomass fuel and another dedicated to the pulverized coal fuel, so that the biomass fuel and the pulverized coal fuel are each pulverized into granular particles having a unique suitable grain size different from each other. For example, pulverizing the biomass fuel having a grain size distribution of about 2 mm or under, which can be prepared without an excess power supply, improves energy efficiency. Additionally, an optimum amount of conveying primary air can be individually selected for each of the biomass fuel and the pulverized coal fuel.

The biomass-mixed, pulverized coal-fired burner according to the aspect of the present invention is capable of burning the biomass fuel in large quantities as the auxiliary fuel for the pulverized coal. The biomass-mixed, pulverized coal-fired burner burns the biomass fuel in a reducing atmosphere, which reduces generation of NOx. Thanks to carbon neutrality of the biomass fuel, the biomass-mixed, pulverized coal-fired burner can practically prevent the amount of $CO_2$ from increasing in the atmosphere, as compared with the combustion of fossil fuels.

Furthermore, a biomass-mixed, pulverized coal-fired boiler to which the biomass-mixed, pulverized coal-fired burner according to the aspect of the present invention is applied can reduce coal consumption, the amount of NOx in exhaust gases, and the amount of $CO_2$ emissions originated from fossil fuels through the use of the biomass fuel as the auxiliary fuel.

MODES FOR CARRYING OUT THE INVENTION

An embodiment of the present invention will be described below with reference to the accompanying drawings.

Figure 1:
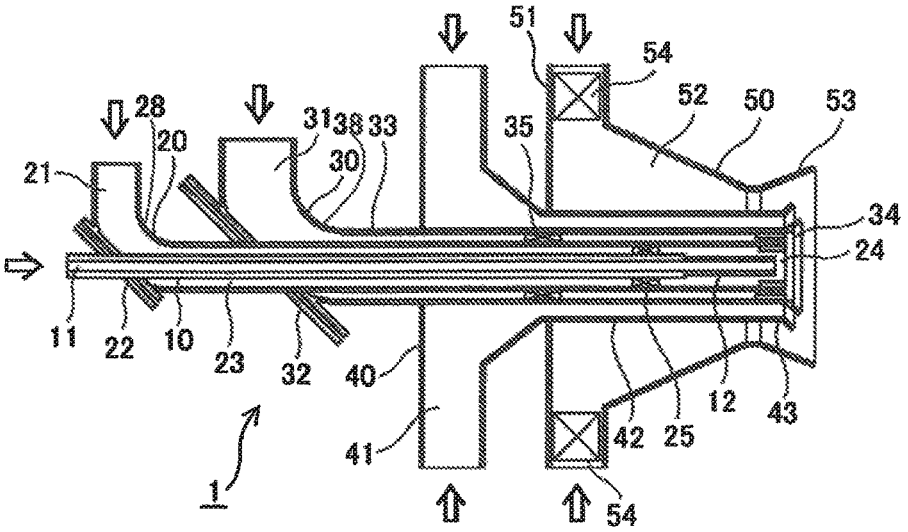
FIG. 1 is a schematic cross-sectional view showing a biomass-mixed, pulverized coal-fired burner according to an embodiment of the present invention.
Figure 2:
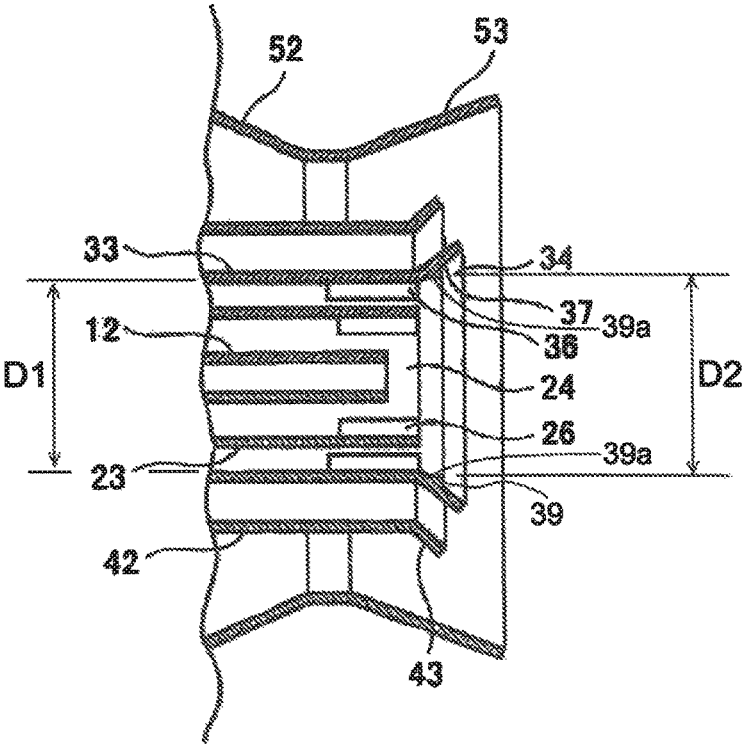
FIG. 2 is an enlarged cross-sectional view showing a jet port portion of the biomass-mixed, pulverized coal-fired burner according to the embodiment.

FIG. 1 is a schematic cross-sectional view showing a biomass-mixed, pulverized coal-fired burner according to an embodiment of the present invention. FIG. 2 is an enlarged cross-sectional view showing a jet port portion of the burner according to the embodiment.

Reference is made to FIG. 1. The biomass-mixed, pulverized coal-fired burner 1 according to the embodiment includes a biomass fuel jet nozzle 20 disposed at a center thereof. The biomass-mixed, pulverized coal-fired burner 1 further includes a pulverized coal fuel jet nozzle 30, a secondary air nozzle 40, and a tertiary air nozzle 50 disposed coaxially in sequence around the biomass fuel jet nozzle 20. It is noted that an auxiliary fuel nozzle 10 that supplies auxiliary or starting liquid or gas fuel may be disposed on a pipe axis of the biomass fuel jet nozzle 20.

The biomass fuel jet nozzle 20 supplies biomass fuel conveyed by biomass fuel primary air into a furnace by way of a center of the biomass-mixed, pulverized coal-fired burner 1. The biomass fuel jet nozzle 20 includes a biomass fuel introducing pipe 21, a biomass fuel reflecting plate 22, a biomass fuel conveying pipe 23, and a biomass fuel jet port 24.

The biomass fuel jet nozzle 20 further includes a biomass fuel swirl vane 25 disposed upstream of the biomass fuel jet port 24 in the biomass fuel conveying pipe 23. The biomass fuel swirl vane 25 is disposed midway in a flow path of a biomass fuel stream in the biomass fuel conveying pipe 23. The biomass fuel swirl vane 25 may, for example, be fixed to an outer wall of the auxiliary fuel nozzle 10.

In addition, the biomass fuel jet nozzle 20 includes a biomass fuel baffle plate 26 disposed on a pipe inner wall at an end portion of the biomass fuel jet port 24. The biomass fuel baffle plate 26 comprises a plurality of barrier plates disposed to extend substantially in parallel with the pipe axis. The biomass fuel baffle plate 26 reduces a swirl velocity of the biomass fuel stream to thereby reduce a centrifugal force, thereby keeping low a release angle of the biomass fuel at the pipe port.

The pulverized coal fuel jet nozzle 30 supplies pulverized coal fuel conveyed by pulverized coal fuel primary air into the furnace by way of an area surrounding the biomass fuel jet port 24. The pulverized coal fuel jet nozzle 30 includes a pulverized coal fuel introducing pipe 31, a pulverized coal fuel reflecting plate 32, a pulverized coal fuel conveying pipe 33, and a pulverized coal fuel jet port 34.

The pulverized coal fuel jet nozzle 30 further includes a pulverized coal fuel swirl vane 35 disposed at an intermediate portion of the pulverized coal fuel conveying pipe 33. The pulverized coal fuel jet nozzle 30 includes a pulverized coal fuel baffle plate 36 disposed on a pipe inner wall at a leading end portion of the pulverized coal fuel conveying pipe 33. The pulverized coal fuel jet nozzle 30 further includes a pulverized coal fuel flame stabilizer 37 disposed at the pulverized coal fuel jet port 34. The pulverized coal fuel flame stabilizer 37 has a funnel-shaped widening ring that widens a jet stream outwardly. The widening ring has a micro-step 39 formed at an intermediate portion thereof, the micro-step stagnating the jet stream and generating a reverse flow in the jet stream, thereby improving ignition performance and flame holding performance. The micro-step 39 being a stepped part that includes a lateral face 39*a* having an inner diameter $D_2$ larger than an inner Diameter $D_1$ of the pulverized coal fuel conveying pipe 33.

A pulverized coal fuel stream jetted into the furnace from the pulverized coal fuel jet port 34 is formed so as to envelop the biomass fuel stream jetted from the biomass fuel jet port 24.

The secondary air nozzle 40 is disposed so as to surround the pulverized coal fuel jet nozzle 30. The secondary air nozzle 40 includes a secondary air introducing pipe 41, a secondary air conveying pipe 42, and a secondary air widening ring 43. The secondary air nozzle 40 draws swirling secondary air from a spirally formed wind box not shown and supplies the secondary air into the furnace by way of a secondary air supply port formed around the pulverized coal fuel jet port 34. The secondary air is supplied to the outside of the pulverized coal fuel stream via the secondary air widening ring 43 disposed at the secondary air supply port.

The tertiary air nozzle 50 is disposed so as to surround the secondary air nozzle 40. The tertiary air nozzle 50 includes a tertiary air introducing pipe 51, a tertiary air throat 52, and a tertiary air widening ring 53. The tertiary air nozzle 50 draws swirling tertiary air from the spirally formed wind box not shown and supplies the tertiary air to the outside of the pulverized coal fuel stream by way of a tertiary air supply port formed so as to surround the secondary air supply port. Swirl strength of the tertiary air can be adjusted with a tertiary air swirl vane 54 disposed at a draw-in port.

The auxiliary fuel nozzle 10 includes an auxiliary fuel conveying pipe 11 disposed at an axial position of the biomass-mixed, pulverized coal-fired burner 1 and an auxiliary fuel jet port 12. The auxiliary fuel nozzle 10 assumes a fuel supply pipe used for supplying auxiliary or starting liquid or gas fuel when a pulverized coal system fails. The addition of the auxiliary fuel nozzle 10 enhances operating stability.

Additionally, the biomass-mixed, pulverized coal-fired burner 1 according to the embodiment further includes, though not shown, a pilot burner and a flame detector.

The biomass fuel jet nozzle 20 in the embodiment requires an amount of primary air that results in the biomass fuel flowing at a flow velocity of 14.5 m/s or higher to ensure that the biomass fuel does not stagnate in the horizontally disposed piping. Preferably, however, the flow velocity of the biomass fuel stream is held below about 30 m/s, because excessively high flow velocities degrade ignition performance and flame holding performance.

The biomass fuel jet nozzle 20 includes the biomass fuel conveying pipe 23 disposed in a horizontal direction and the biomass fuel introducing pipe 21 connected substantially perpendicularly to the biomass fuel conveying pipe 23 via a bent section 28. The biomass fuel stream flowing from the biomass fuel introducing pipe 21 collides against the flat biomass fuel reflecting plate 22 disposed at the bent section 28 and is thereby bent substantially at 90°.

The bent section 28, if formed with a bent pipe, causes the introduced biomass fuel stream to be smoothly bent. Thus, heavy fuel particles in the stream tend to reside on an outer circumferential side of the bent pipe due to a centrifugal force, so that a fuel distribution inside the pipe becomes uneven circumferentially at an outlet of the bent pipe. The nozzle according to the embodiment causes the biomass fuel stream to collide with the flat biomass fuel reflecting plate 22 to thereby disturb the stream, thereby enhancing uniformity of the fuel distribution in the circumferential direction inside the pipe.

The biomass fuel stream conveyed by the primary air flows past the bent section 28 provided with the biomass fuel reflecting plate 22, which reduces unevenness in the circumferential direction. Meanwhile, concentration distribution of the biomass fuel at a stream cross section is disturbed. The biomass fuel swirl vane 25 is thus disposed downstream of the bent section 28 to thereby adjust the fuel concentration distribution in the biomass fuel stream.

The biomass fuel swirl vane 25 comprises a plurality of swirl vanes disposed in a flow path downstream of the bent section in the biomass fuel conveying pipe 23. The swirl vanes are inclined relative to the pipe axis. The swirl vanes rotate the biomass fuel stream about the pipe axis and use a centrifugal force to make the fuel concentration lower at the center side and higher on the outer circumferential side and make the concentration distribution substantially uniform in the circumferential direction.

The biomass fuel baffle plate 26 is disposed on a pipe inner wall immediately upstream of the biomass fuel jet port 24 that jets fuel into the furnace. The biomass fuel baffle plate 26 can reduce a swirl force of the biomass fuel stream given by the biomass fuel swirl vane 25, thereby reducing a spread angle of the fuel stream after jetting. The biomass fuel baffle plate 26 comprises a plurality of flat plates, each flat plate being disposed at substantially equal intervals in the circumferential direction and extending along the pipe axis. The number, size, and inclination relative to the pipe axis of the flat plates constituting the biomass fuel baffle plate 26 may be determined as appropriate according to the swirl force of the biomass fuel stream and the spread angle after jetting.

The biomass fuel jet port 24 has a substantially straight leading end, unlike a funnel-shaped opening found in, for example, the pulverized coal fuel jet port 34. This enables the biomass fuel stream to be released into a core portion of the pulverized coal fuel stream formed on the outside of the biomass fuel stream, without allowing the biomass fuel stream to spread excessively.

The pulverized coal fuel jet nozzle 30 also includes the pulverized coal fuel conveying pipe 33 disposed in a horizontal direction and the pulverized coal fuel introducing pipe 31 connected substantially perpendicularly to the pulverized coal fuel conveying pipe 33 via a bent section 38. The pulverized coal fuel stream conveyed by the primary air and flowing from the pulverized coal fuel introducing pipe 31 collides against the flat pulverized coal fuel reflecting plate 32 disposed at the bent section 38 and is thereby bent substantially at 90°. The pulverized coal fuel stream in the embodiment, which collides with the flat pulverized coal fuel reflecting plate 32, can enhance uniformity of the fuel distribution in the circumferential direction inside the pipe.

Additionally, the pulverized coal fuel swirl vane 35 disposed downstream of the bent section in the flow path for conveying the pulverized coal fuel adjusts the fuel concentration distribution in the pulverized coal fuel stream inside the pulverized coal fuel conveying pipe 33.

The pulverized coal fuel swirl vane 35 comprises a plurality of swirl vanes disposed between an outer wall of the biomass fuel conveying pipe 23 and an inner wall of the pulverized coal fuel conveying pipe 33. The swirl vanes change the pulverized coal fuel stream into a swirl flow that whirls around the axis, thereby making the fuel concentration lower at the center side and higher on the outer circumferential side and making the concentration distribution substantially uniform in the circumferential direction.

The pulverized coal fuel stream changed into the swirl flow by the pulverized coal fuel swirl vane 35 is jetted into the furnace from the pulverized coal fuel jet port 34 disposed so as to surround the biomass fuel jet port 24.

The pulverized coal fuel baffle plate 36 is disposed on a pipe inner wall immediately upstream of the pulverized coal fuel jet port 34. The pulverized coal fuel baffle plate 36 reduces a swirl force of the pulverized coal fuel stream jetted into the furnace, thereby reducing the spread angle of the fuel stream after jetting. Additionally, the pulverized coal fuel flame stabilizer 37 is funnel-shaped and stepped, which forms a reverse flow swirl, thereby improving flame holding performance.

Similarly to the biomass fuel baffle plate 26 formed at the biomass fuel jet port 24, the pulverized coal fuel baffle plate 36 comprises a plurality of flat plates, each flat plate being disposed at substantially equal intervals in the circumferential direction and extending substantially in parallel with the pipe axis. The number, size, and orientation of the flat plates constituting the pulverized coal fuel baffle plate 36 may be determined as appropriate according to the swirl force of the pulverized coal fuel stream and the spread angle after jetting.

When the biomass fuel stream exists, the pulverized coal fuel stream is formed so as to envelop the biomass fuel stream.

The biomass fuel stream has a discharge angle smaller than that of the pulverized coal fuel stream. Thus, immediately after the biomass fuel stream is discharged into the furnace, the pulverized coal fuel maintains a condition in which the pulverized coal fuel covers the biomass fuel like a sheath, so that the biomass fuel burns in a condition of being enveloped by a pulverized coal flame. This achieves reliable ignition and flame holding performance of the biomass fuel.

The secondary air and the tertiary air are mixed with the pulverized coal fuel stream that spreads from the pulverized coal fuel jet port 34 into the furnace and function as part of combustion air to burn the pulverized coal fuel.

The secondary air is supplied as a buffer stream into an inside of the tertiary air stream supplied in a large quantity. The supplied secondary air first contacts the pulverized coal fuel stream to thereby bend the pulverized coal fuel stream inward, so that the pulverized coal fuel stream is delayed in meeting a tertiary air swirl flow. A condition in which the fuel concentration is high is thereby sustained. Thus, the secondary air has actions of achieving stable ignition performance and improving flame holding performance. In addition, combustion time with low oxygen conditions is ensured, so that NOx emission can be reduced even more effectively.

In the biomass-mixed, pulverized coal-fired burner 1 shown in FIGS. 1 and 2, air is drawn in from the spirally formed wind box in order to form a tertiary air swirl flow around the pulverized coal fuel jet port 34. Additionally, the tertiary air swirl vane 54 is disposed near the draw-in port of the tertiary air introducing pipe 51 of the tertiary air nozzle 50 from the wind box. The tertiary air swirl vane 54 allows the swirl strength to be adjusted. As with the tertiary air, the secondary air, when drawn from the spirally formed wind box, becomes a swirl flow. The burner may include a swirl vane, though not shown, as necessary.

The biomass fuel stream, because of its being supplied from a core side of a burning pulverized coal fuel stream, is readily ignited in the pulverized coal flame and the flame is stably held. This results in minor restrictions on a mixing ratio of the biomass fuel and the pulverized coal fuel, allowing a large amount of biomass fuel to be burned. Under a condition of a short supply of biomass fuel, the biomass-mixed, pulverized coal-fired burner 1 may be used as a pulverized coal-fired burner that burns only the pulverized coal. It is noted that, when only the pulverized coal is burned, the pulverized coal can be burned favorably, if air with a velocity lower than that of the air conveying the pulverized coal and the biomass fuel is supplied as core air to the biomass fuel jet nozzle 20.

The conventional pulverized coal-fired burner generally requires that coal be pulverized in order to enhance combustion efficiency, the coal being typically pulverized into fine particles of commonly 200 μm or less, preferably about 70 μm, for use with the conventional pulverized coal burner.

When, for example, only the pulverized coal fuel that has been processed such that fuel particle diameters of 74 μm or less account for 80% is burned, it has been determined that the biomass-mixed, pulverized coal-fired burner according to the embodiment can burn the pulverized coal such that a load factor to a rated value falls within a range of 40% to 100%, if A/C (fuel conveying air flow rate ($Nm^3/h$) to fuel (kg/h): unit $Nm^3/kg$) is adjusted to fall within a range of 1.7 to 3.0.

With the biomass fuel, however, electric power for pulverization increases sharply at smaller grain sizes involved in pulverizing the material, aggravating economy. In addition, the biomass fuel is easier to burn than the coal for the same particle diameter, which allows the pulverized grain size to be made larger. As a result, preferably, the biomass fuel is pulverized to a grain size distribution of substantially 2 mm or under.

The biomass-mixed, pulverized coal-fired burner 1 according to the embodiment includes the pulverized coal fuel jet nozzle 30 that burns the pulverized coal fuel and the biomass fuel jet nozzle 20 that feeds the biomass fuel into the pulverized coal flame to thereby be ignited and hold its flame. A pulverizing mill dedicated to the biomass fuel is employed to process the biomass fuel into granular particles having a grain size different from that of the pulverized coal. The biomass fuel particles are conveyed by an air stream independent of the pulverized coal and supplied to the biomass fuel jet nozzle 20.

As such, the pulverized coal fuel and the biomass fuel can be burned with high efficiency under respective optimum combustion conditions without being heavily restricted by a mixed fuel burning ratio.

Figure 3:
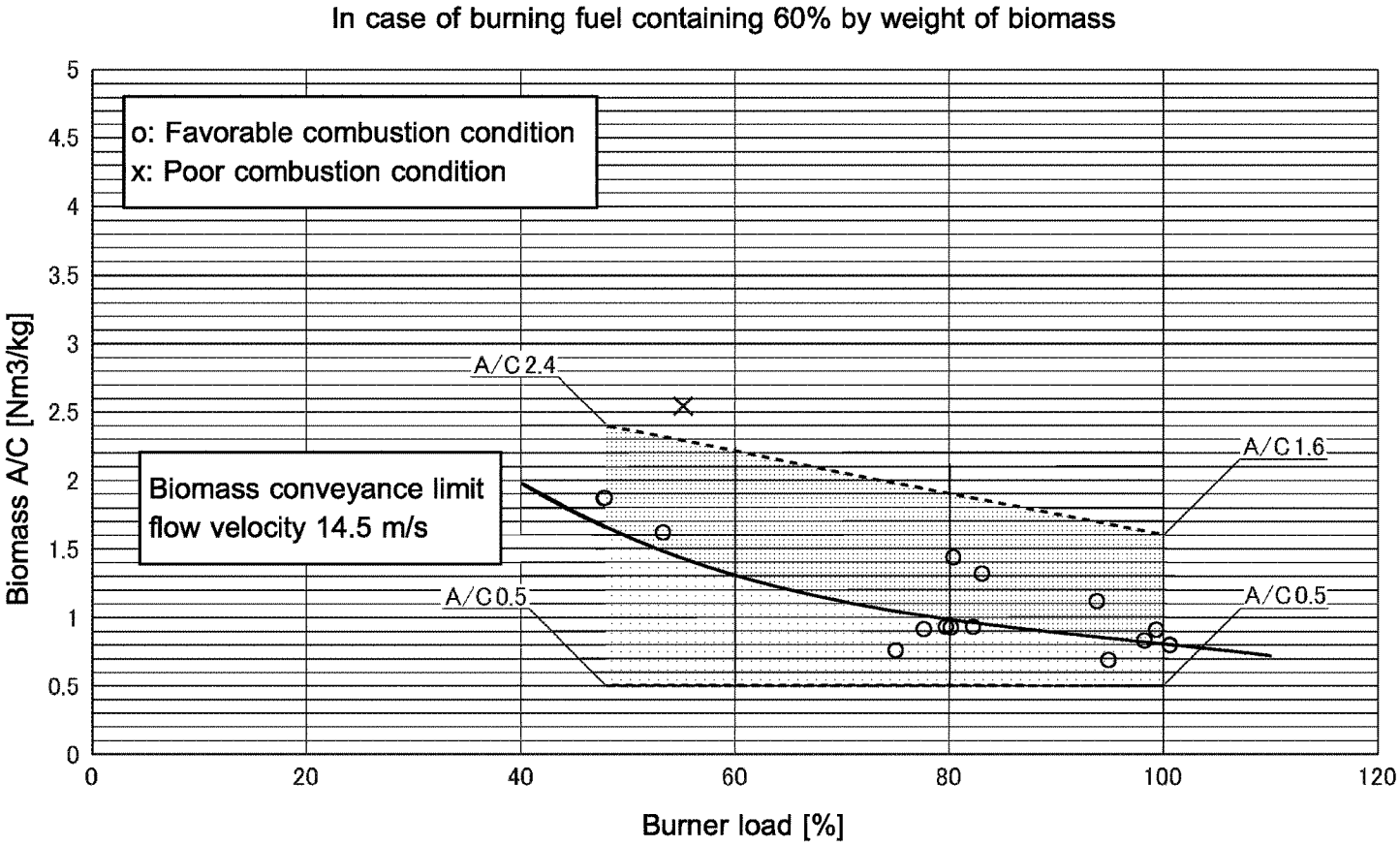
FIG. 3 is a diagram showing a relation between burner load and A/C representing an operating range of the biomass-mixed, pulverized coal-fired burner according to the embodiment.

FIG. 3 shows a relation between burner load and A/C (a value of the fuel conveying air flow rate divided by the amount of fuel loaded) when the fuel contains 60% by weight of the biomass (40% by weight of the pulverized coal) in the biomass-mixed, pulverized coal-fired burner 1 according to the embodiment. In FIG. 3, the abscissa represents a burner load factor (%) relative to the rating and the ordinate represents A/C ($Nm^3/kg$) relating to the biomass fuel. Additionally, in FIG. 3, o denotes a case in which the flame was steady with favorable ignition and flame holding performance in the combustion experiment, and x denotes a case in which the combustion was poor with degraded ignition and flame holding performance. The shaded area in FIG. 3 represents a recommended operating range.

Referring to FIG. 3, the biomass-mixed, pulverized coal-fired burner 1 according to the embodiment is determined to be industrially applicable in a recommended operating range that, with fuel containing 60% by weight of the biomass fuel, is sandwiched between a straight line extending from biomass A/C 0.5 to biomass A/C 1.6 at a load factor of 100% and a straight line extending from biomass A/C 0.5 to biomass A/C 2.4 at a load factor of 50% and drawn in view of a plot position of the poor combustion condition, the recommended operating range having an upper edge partitioned by an upper limit line under which the flame holding performance is ensured, the upper limit line being drawn to pass the upper end point of the straight line at the load factor of 100% and the upper end point of the straight line at the load factor of 50% and drawn to circumvent the x mark at which the combustion is poor, and having a lower edge partitioned by a straight line.

It is noted that a range with a load factor of less than 50% is not recommended, in which steady ignition or steady flame holding cannot be obtained because of a low fuel concentration in the biomass fuel.

In FIG. 3, the broad solid curve represents a conveyance limit flow velocity of 14.5 m/s at which the fuel does not stagnate in the biomass fuel jet nozzle 20 disposed horizontally. Preferably, the actual burner is operated in the darker shaded area above the broad solid curve. It is noted that the conveyance limit flow velocity varies according to a mounting position of the biomass fuel jet nozzle 20.

A biomass-mixed, pulverized coal-fired boiler capable of combustion at a high mixed fuel burning ratio of biomass can be provided by applying the biomass-mixed, pulverized coal-fired burner according to the present invention to a new or existing boiler. The biomass-mixed, pulverized coal-fired boiler to which the biomass, pulverized coal-fired burner of the embodiment is applied burns a large volume of woody biomass fuel to thereby save coal consumption and reduce the amount of CO2 emissions derived from fossil fuels. Since the biomass-mixed, pulverized coal-fired burner burns the biomass fuel in a reducing atmosphere, the amount of NOx in exhaust gases can be reduced.

DESCRIPTION OF REFERENCE NUMERALS

1: biomass-mixed, pulverized coal-fired burner
10: auxiliary fuel nozzle
11: auxiliary fuel conveying pipe
12: auxiliary fuel jet port
20: biomass fuel jet nozzle
21: biomass fuel introducing pipe
22: biomass fuel reflecting plate
23: biomass fuel conveying pipe
24: biomass fuel jet port
25: biomass fuel swirl vane

26: biomass fuel baffle plate
28: biomass fuel bent section
30: pulverized coal fuel jet nozzle
31: pulverized coal fuel introducing pipe
32: pulverized coal fuel reflecting plate
33: pulverized coal fuel conveying pipe
34: pulverized coal fuel jet port
35: pulverized coal fuel swirl vane
36: pulverized coal fuel baffle plate
37: pulverized coal fuel flame stabilizer
38: pulverized coal fuel bent section
40: secondary air nozzle
41: secondary air introducing pipe
42: secondary air conveying pipe
43: secondary air widening ring
50: tertiary air nozzle
51: tertiary air introducing pipe
52: tertiary air throat
53: tertiary air widening ring
54: tertiary air swirl vane

The invention claimed is:

1. A biomass-mixed, pulverized coal-fired burner, comprising:

a biomass fuel jet nozzle having a biomass fuel jet port that jets biomass fuel conveyed by biomass fuel primary air as a biomass fuel stream;

a pulverized coal fuel jet nozzle having a pulverized coal fuel jet port that surrounds an opening in the biomass fuel jet port, the pulverized coal fuel jet nozzle jetting pulverized coal fuel conveyed by pulverized coal fuel primary air as a pulverized coal fuel stream;

a secondary air nozzle having a secondary air jet port that surrounds an opening in the pulverized coal fuel jet port, the secondary air jet port jetting secondary air; and a tertiary air nozzle having a tertiary air jet port that surrounds the secondary air jet port, the tertiary air jet port jetting a tertiary air swirl flow, wherein the biomass fuel jet nozzle includes a biomass fuel conveying pipe that forms a flow path for the biomass fuel stream, and includes a biomass fuel swirl vane that converts the biomass fuel stream to a swirl flow whirling around an axis of the biomass fuel conveying pipe to thereby make a fuel concentration lower on an axis side of the biomass fuel conveying pipe and higher on an outer circumferential wall side of the biomass fuel conveying pipe, the biomass fuel jet port has a pipe end extending in parallel with a pipe axis, the biomass fuel jet nozzle further includes a biomass fuel baffle plate disposed on a pipe inner wall upstream of the pipe end, the biomass fuel baffle plate reducing a swirl of the biomass fuel stream jetted from the biomass fuel jet port, the pulverized coal fuel jet nozzle includes a pulverized coal fuel conveying pipe that forms a flow path for the pulverized coal fuel stream, a pulverized coal fuel swirl vane that converts the pulverized coal fuel stream to a swirl flow whirling around an outer circumference of the biomass fuel jet nozzle to thereby make a fuel concentration higher on an outer circumferential wall side of the pulverized coal fuel conveying pipe, a flame stabilizer disposed at a pipe end of the pulverized coal fuel jet port and having a funnel-shaped widening ring including an inner face having an inner diameter larger than an inner diameter of the pulverized coal fuel convening pipe and a stepped part formed at the inner face of the widening ring and continuously extending around the entire circumference of the pulverized coal fuel jet port, and a pulverized coal fuel baffle plate disposed on a pipe inner wall upstream of the flame stabilizer, the pulverized coal fuel baffle plate reducing a swirl of the pulverized coal fuel stream jetted from the pulverized coal fuel jet port, a spread angle of the pulverized coal fuel stream jetted from the pulverized coal fuel jet port is reduced by the flame stabilizer having the stepped part and the pulverized coal fuel baffle plate, the stepped part includes a lateral face having an inner diameter larger than an inner diameter of the pulverized coal fuel conveying pipe, the secondary air jetted from the secondary air jet port forms a buffer stream between the pulverized coal fuel stream and the tertiary air swirl flow, and the pulverized coal fuel stream is formed such that the biomass fuel stream jetted from the biomass fuel jet port is enveloped by the pulverized coal fuel stream jetted from the pulverized coal fuel jet port.

2. The biomass-mixed, pulverized coal-fired burner according to claim 1, wherein the biomass fuel jet nozzle includes a biomass fuel bent section disposed upstream of the biomass fuel swirl vane, and the pulverized coal fuel jet nozzle includes a pulverized coal fuel bent section disposed upstream of the pulverized coal fuel swirl vane.

3. The biomass-mixed, pulverized coal-fired burner according to claim 1, wherein the biomass fuel primary air is supplied in such a quantity that a velocity of a fuel conveying stream in the biomass fuel jet nozzle falls within a range between 14.5 m/s and 30 m/s.

4. The biomass-mixed, pulverized coal-fired burner according to claim 2, wherein the biomass fuel primary air is supplied in such a quantity that a velocity of a fuel conveying stream in the biomass fuel jet nozzle falls within a range between 14.5 m/s and 30 m/s.

5. The biomass-mixed, pulverized coal-fired burner according to claim 1, wherein the biomass fuel primary air is supplied such that the biomass-mixed, pulverized coal-fired burner is operated in a range that, with fuel containing 60% by weight of biomass fuel, is sandwiched between a first straight line and a second straight line as follows: the first straight line extending from A/C 0.5 relating to the biomass fuel to A/C 1.6 relating to the biomass fuel at a load factor of 100% of the biomass-mixed, pulverized coal-fired burner; and the second straight line extending from A/C 0.5 relating to the biomass fuel to A/C 2.4 relating to the biomass fuel at a load factor of 50% of the biomass-mixed, pulverized coal-fired burner, wherein the A/C relating to the biomass fuel is a ratio of biomass fuel primary air flow rate ($Nm^3/h$) to biomass fuel (kg/h).

6. The biomass-mixed, pulverized coal-fired burner according to claim 2, wherein the biomass fuel primary air is supplied such that the biomass-mixed, pulverized coal-fired burner is operated in a range that, with fuel containing 60% by weight of biomass fuel, is sandwiched between a first straight line and a second straight line as follows: the first straight line extending from A/C 0.5 relating to the biomass fuel to A/C 1.6 relating to the biomass fuel at a load factor of 100% of the biomass-mixed, pulverized coal-fired burner; and the second straight line extending from A/C 0.5 relating to the biomass fuel to A/C 2.4 relating to the biomass fuel at a load factor of 50% of the biomass-mixed, pulverized coal-fired burner, wherein the A/C relating to the biomass fuel is a ratio of biomass fuel primary air flow rate ($Nm^3/h$) to biomass fuel (kg/h).

7. The biomass-mixed, pulverized coal-fired burner according to claim 3, wherein the biomass fuel primary air is supplied such that the biomass-mixed, pulverized coal-fired burner is operated in a range that, with fuel containing 60% by weight of biomass fuel, is sandwiched between a first straight line and a second straight line as follows: the first straight line extending from A/C 0.5 relating to the biomass fuel to A/C 1.6 relating to the biomass fuel at a load factor of 100% of the biomass-mixed, pulverized coal-fired burner; and the second straight line extending from A/C 0.5 relating to the biomass fuel to A/C 2.4 relating to the biomass fuel at a load factor of 50% of the biomass-mixed, pulverized coal-fired burner, wherein the A/C relating to the biomass fuel is a ratio of biomass fuel primary air flow rate ($Nm^3/h$) to biomass fuel (kg/h).

8. The biomass-mixed, pulverized coal-fired burner according to claim 4, wherein the biomass fuel primary air is supplied such that the biomass-mixed, pulverized coal-fired burner is operated in a range that, with fuel containing 60% by weight of biomass fuel, is sandwiched between a first straight line and a second straight line as follows: the first straight line extending from A/C 0.5 relating to the biomass fuel to A/C 1.6 relating to the biomass fuel at a load factor of 100% of the biomass-mixed, pulverized coal-fired burner; and the second straight line extending from A/C 0.5 relating to the biomass fuel to A/C 2.4 relating to the biomass fuel at a load factor of 50% of the biomass-mixed, pulverized coal-fired burner, wherein the A/C relating to the biomass fuel is a ratio of biomass fuel primary air flow rate ($Nm^3/h$) to biomass fuel (kg/h).

9. A fuel combustion method comprising:

burning biomass fuel and pulverized coal fuel using the biomass-mixed, pulverized coal-fired burner according to claim 1.

10. The fuel combustion method according to claim 9, wherein the biomass fuel primary air is supplied in such a quantity that a velocity of a fuel conveying stream in the biomass fuel jet nozzle falls within a range between 14.5 m/s and 30 m/s.

11. The fuel combustion method according to claim 9, wherein the biomass-mixed, pulverized coal-fired burner is operated in a range that, with fuel containing 60% by weight of biomass fuel, is sandwiched between a first straight line and a second straight line as follows: the first straight line extending from A/C 0.5 relating to the biomass fuel to A/C 1.6 relating to the biomass fuel at a load factor of 100% of the biomass-mixed, pulverized coal-fired burner; and the second straight line extending from A/C 0.5 relating to the biomass fuel to A/C 2.4 relating to the biomass fuel at a load factor of 50% of the biomass-mixed, pulverized coal-fired burner, wherein the A/C relating to the biomass fuel is a ratio of biomass fuel primary air flow rate ($Nm^3/h$) to biomass fuel (kg/h).

12. The fuel combustion method according to claim 10, wherein the biomass-mixed, pulverized coal-fired burner is operated in a range that, with fuel containing 60% by weight of biomass fuel, is sandwiched between a first straight line and a second straight line as follows: the first straight line extending from A/C 0.5 relating to the biomass fuel to A/C 1.6 relating to the biomass fuel at a load factor of 100% of the biomass-mixed, pulverized coal-fired burner; and the second straight line extending from A/C 0.5 relating to the biomass fuel to A/C 2.4 relating to the biomass fuel at a load factor of 50% of the biomass-mixed, pulverized coal-fired burner, wherein the A/C relating to the biomass fuel is a ratio of biomass fuel primary air flow ($Nm^3/h$) to biomass fuel (kg/h).

* * * * *